US011168943B2

(12) United States Patent
Chi

(10) Patent No.: US 11,168,943 B2
(45) Date of Patent: Nov. 9, 2021

(54) CHANNEL FIN HEAT EXCHANGERS AND METHODS OF MANUFACTURING THE SAME

(71) Applicant: API HEAT TRANSFER THERMASYS CORPORATION, Buffalo, NY (US)

(72) Inventor: Yen-Chu Chi, Montgomery, AL (US)

(73) Assignee: API Heat Transfer Thermasys Corporation, Buffalo, NY (US)

( * ) Notice: Subject to any disclaimer, the term of this patent is extended or adjusted under 35 U.S.C. 154(b) by 0 days.

(21) Appl. No.: 16/158,470

(22) Filed: Oct. 12, 2018

(65) Prior Publication Data

US 2020/0116432 A1 Apr. 16, 2020

(51) Int. Cl.
*F28D 9/00* (2006.01)
*F28F 3/02* (2006.01)

(52) U.S. Cl.
CPC ..... *F28D 9/0062* (2013.01); *F28F 3/025* (2013.01); *F28F 2240/00* (2013.01)

(58) Field of Classification Search
CPC .... F28D 1/0391; F28D 9/0037; F28D 9/0031; F28D 9/0062; B21C 37/155; B21C 37/0822; B21C 37/0826; B21C 37/14; B21C 37/153; B21C 37/151; B21C 37/154; B21D 53/04; B21D 53/06; F28F 1/04; F28F 3/025
See application file for complete search history.

(56) References Cited

U.S. PATENT DOCUMENTS 2,846,198 A 8/1958 Sturges
2,912,749 A 11/1959 Bauernfeind et al.
3,053,511 A * 9/1962 Godfrey ..... C23F 13/08 165/133
3,241,607 A 3/1966 Rutledge
3,495,656 A 2/1970 Dickson
3,517,731 A 6/1970 Rothman
(Continued)

FOREIGN PATENT DOCUMENTS

JP 3580942 10/2004
JP 2016-142490 8/2016

OTHER PUBLICATIONS

International Search Report for International Application No. PCT/US2019/032110, dated Aug. 27, 2019, (11 pages).

*Primary Examiner* — Tho V Duong
(74) *Attorney, Agent, or Firm* — Troutman Pepper Hamilton Sanders LLP

(57) ABSTRACT

A heat exchanger having alternating first and second fluid passages with perpendicular flow directions separated by channels, spacer bars located at sides of the first fluid passages, side walls located at sides of the second fluid passages that are formed by folded portions of pairs of adjacent channels coupled to form a joint, fins located within the fluid passages, and side panels located at and sealing oppositely disposed ends of the series of alternating fluid passages. The heat exchanger can be produced with methods that include providing and advancing a continuous, elongated strip of material along a path, flattening the strip, folding edges of the strip to define partial fold patterns, cutting a formed portion of the strip to produce one of the channels, and assembling pairs of the channels such that the respective partial fold patterns interlock or overlap to define a joint.

8 Claims, 7 Drawing Sheets

(56) References Cited

U.S. PATENT DOCUMENTS

| | | | | |
|---|---|---|---|---|
| 3,601,185 | A | 8/1971 | Rothman | |
| 4,006,776 | A | 2/1977 | Pfouts et al. | |
| 4,246,963 | A | 1/1981 | Anderson | |
| 4,473,111 | A | 9/1984 | Steeb | |
| 4,607,684 | A | 8/1986 | Wiard et al. | |
| 4,681,155 | A | 7/1987 | Kredo | |
| 4,729,428 | A | 3/1988 | Yasutake et al. | |
| 4,804,041 | A | 2/1989 | Hasegawa et al. | |
| 4,934,455 | A | 6/1990 | Hasegawa et al. | |
| 5,538,079 | A | 7/1996 | Pawlick | |
| 5,709,264 | A | 1/1998 | Sweeney et al. | |
| 6,019,169 | A | 2/2000 | Ruppel et al. | |
| 6,857,469 | B2 | 2/2005 | Meller et al. | |
| 7,107,680 | B2 * | 9/2006 | Ueda | B23K 1/0012 29/890.053 |
| 8,079,508 | B2 | 12/2011 | Foust | |
| 8,091,621 | B2 | 1/2012 | Zobel et al. | |
| 8,276,654 | B2 | 10/2012 | Zaffetti et al. | |
| 8,579,021 | B2 | 11/2013 | Kuehne et al. | |
| 8,726,508 | B2 * | 5/2014 | Zobel | B21C 37/151 165/177 |
| 2009/0014165 | A1 * | 1/2009 | Zobel | B21C 37/157 165/177 |
| 2009/0218085 | A1 | 9/2009 | Rogers et al. | |
| 2016/0265854 | A1 | 9/2016 | Rice | |

* cited by examiner

CHANNEL FIN HEAT EXCHANGERS AND METHODS OF MANUFACTURING THE SAME

BACKGROUND OF THE INVENTION

The present invention generally relates to heat exchangers. The invention particularly relates to channel fin heat exchangers having fluid passages defined by pairs of channels coupled to one another with folded joints.

Heavy duty plate fin heat exchangers are generally characterized by first and second flow passages having perpendicular flow directions, commonly referred to as cross flow. The flow passages are commonly formed by series of spacer bars and plates enclosing fins in parallel at a predetermined spacing. Plate fin heat exchangers are usually produced with piece-by-piece processes that generally require a significant amount of manual labor to manufacture the components and assemble the heat exchanger cores. These products include a relatively large number of brazed joints which may be vulnerable to leaks. As such, these products commonly provide low first pass yield braze rates leading to increased scrap rates and/or costly repairs.

Due to the high costs commonly associated with plate fin heat exchangers, end users often use less expensive but also less durable types of heat exchangers including tube-header heat exchangers, such as those disclosed in U.S. Pat. No. 4,233,719 to Rhodes and U.S. Pat. No. 4,311,193 to Verhaeghe et al. Tube-header heat exchangers generally use fewer components relative to comparable plate fin heat exchangers. However, these products often require customized header plates at various core depths or core stacking heights leading to expensive tooling, increased complexity during production and assembly, and a loss of reliability relative to plate fin heat exchangers due in part to a lack of internal fins and often thin outer tube walls.

In view of the above, it can be appreciated that there are certain problems, shortcomings or disadvantages associated with the prior art, and that it would be desirable if improved methods were available for manufacturing heat exchangers that were capable of at least partly overcoming or avoiding these problems, shortcomings or disadvantages.

BRIEF DESCRIPTION OF THE INVENTION

The present invention provides channel fin heat exchangers and methods of manufacturing heat exchanger cores for use in the same, for the purpose of producing reliable, high-pressure capacity heat exchangers with semi or fully automated processes.

According to one aspect of the invention, a heat exchanger is provided that includes a series of alternating first and second fluid passages with the first fluid passages having a first flow direction and the second fluid passages having a second flow direction perpendicular to the first flow direction, channels located between and separating the first and second fluid passages formed of a multilayer of a braze clad alloy or a multilayer of brazing material having a thickness of greater than 0.3 mm, spacer bars located at and sealing sides of the first fluid passages with longitudinal axes parallel to the first flow direction and perpendicular to the second flow direction, side walls located at and sealing sides of the second fluid passages with longitudinal axes parallel to the second flow direction and perpendicular to the first flow direction and formed by folded portions of pairs of adjacent channels coupled to form a joint, fins located within the first and second fluid passages, and side panels located at and sealing oppositely disposed ends of the series of alternating first and second fluid passages.

According to another aspect of the invention, a method is provided for manufacturing a heat exchanger core that includes a series of alternating first and second fluid passages separated by channels, the first fluid passages having a first flow direction and the second fluid passages having a second flow direction perpendicular to the first flow direction. The method includes providing a continuous, elongated planar strip of material, advancing the strip in a longitudinal direction thereof along a path, flattening the strip, folding edges of the strip to define partial fold patterns having folded portions perpendicular to unfolded portions of the strip, cutting a formed portion of the strip to produce one of the channels having a predetermined longitudinal length, and assembling pairs of the channels such that the respective partial fold patterns interlock or overlap to define a joint.

Technical effects of the heat exchanger and the method described above preferably include the ability to use semi or fully automated processes to produce solid braze joints free of gaps and leaks and thereby yield reliable, high-pressure capacity heat exchangers.

Other aspects and advantages of this invention will be further appreciated from the following detailed description.

DETAILED DESCRIPTION OF THE INVENTION

FIGS. 1 through 12C represent heat exchangers and components thereof that combine features of conventional plate fin heat exchangers and tube-header heat exchangers to yield what are referred to herein as channel fin heat exchangers.

Figure 1:
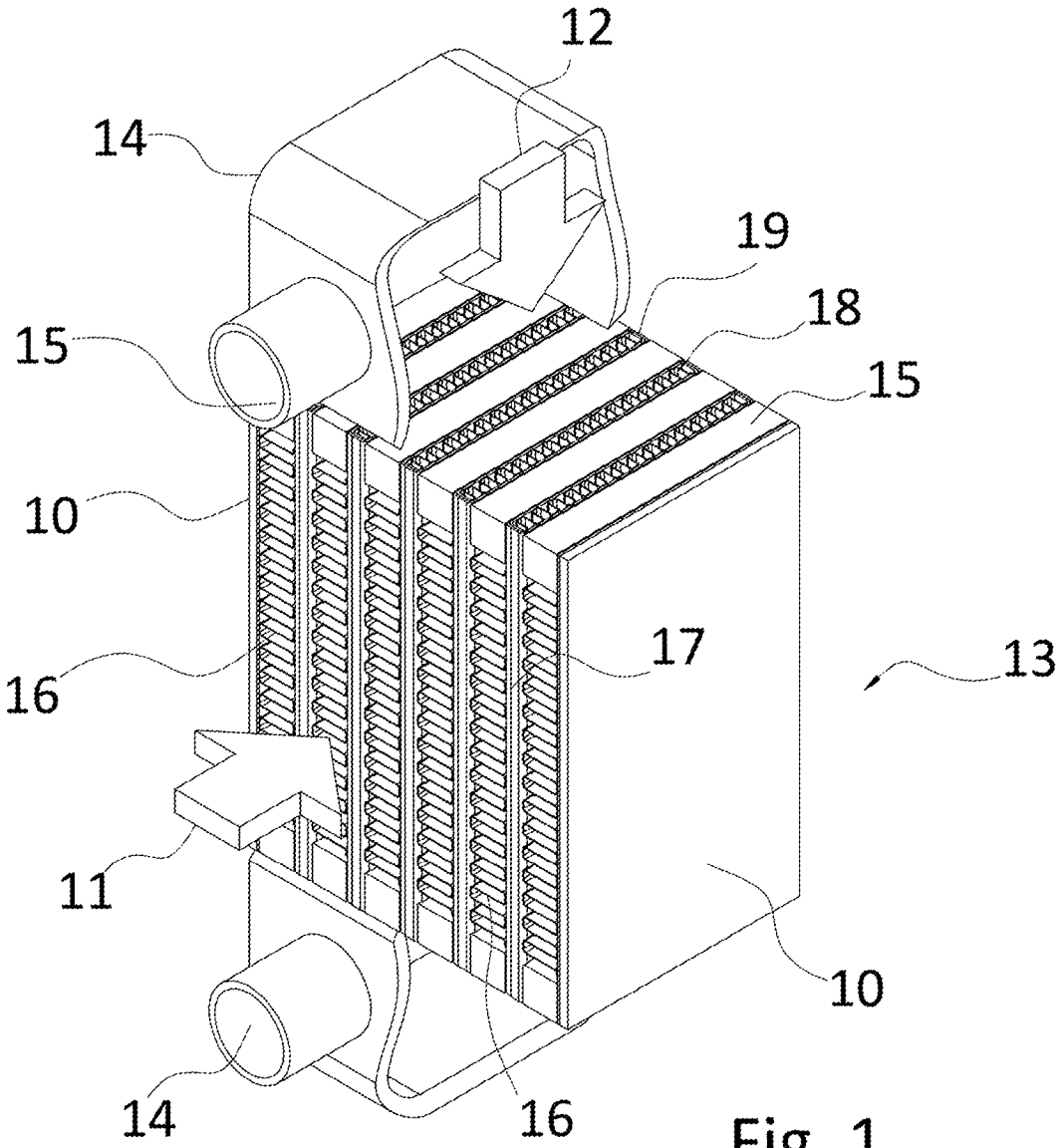
FIG. 1 is an isometric view representing a channel fin heat exchanger with partially removed tanks in accordance with a first embodiment of the present invention.
Figure 2:
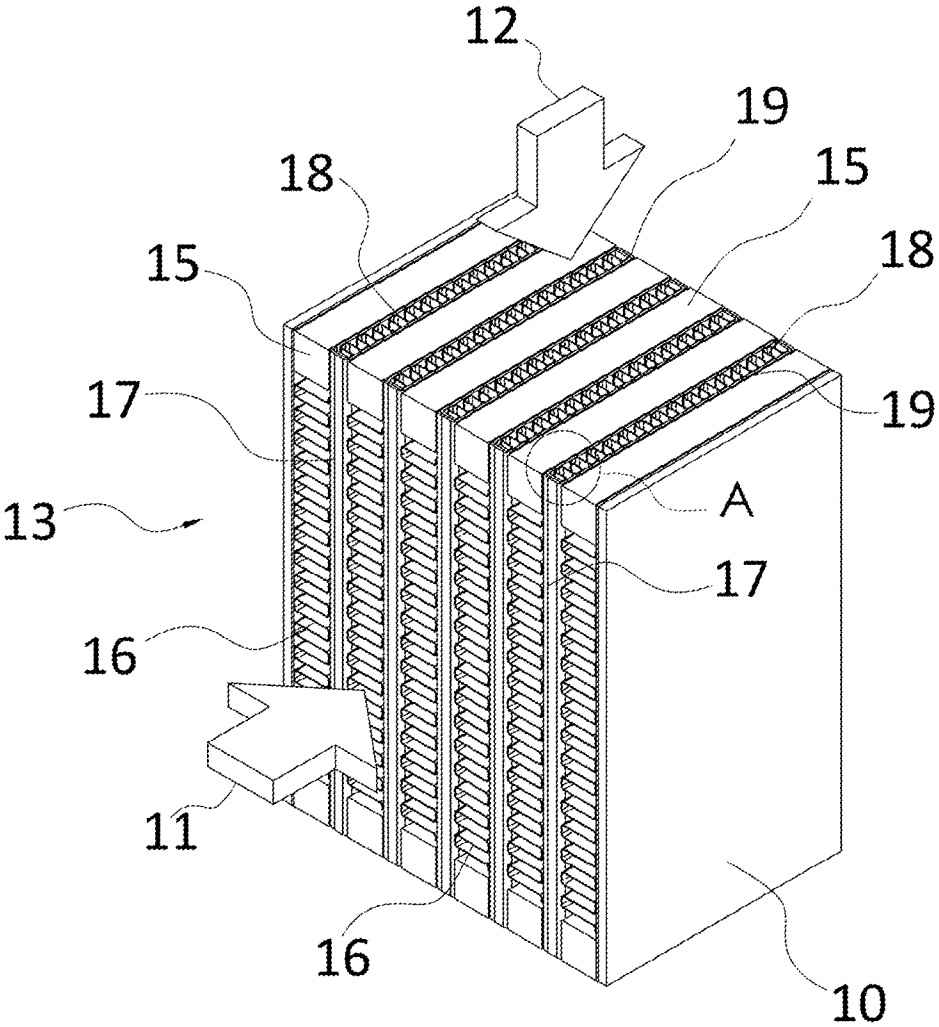
FIG. 2 is an isometric view representing the channel fin heat exchanger core of FIG. 1.

FIG. 1 represents a first nonlimiting channel heat exchanger that includes a channel fin heat exchanger core 13 and a corresponding tank 14 (portions of which have been removed for clarity). FIG. 2 represents an isolated view of the channel fin heat exchanger core 13 which includes a series of alternating first and second fluid passages each separated from adjacent passages by a parting sheet or channel 19. The first and second fluid passages allow fluids to flow in perpendicular first and second directions (indicated with arrows 11 and 12, respectively) within the channel fin heat exchanger core 13 such that the fluids contact corrugated (serpentine) fins 16 and 18 located therein.

Side panels 10 are located on ends of the series of fluid passages and provide a bounding surface on sides of outermost fins 16 to improve the strength of the heat exchanger structure. Although represented as planar, the side panels 10 may include various mounting features in certain applications.

Figure 3:
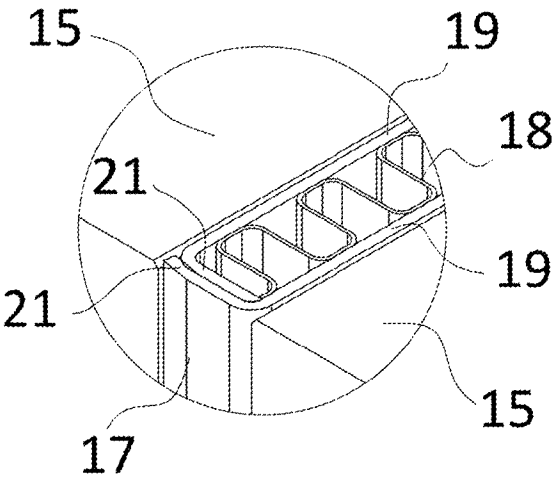
FIG. 3 is an enlarged view of section A of FIG. 2.
Figure 7:
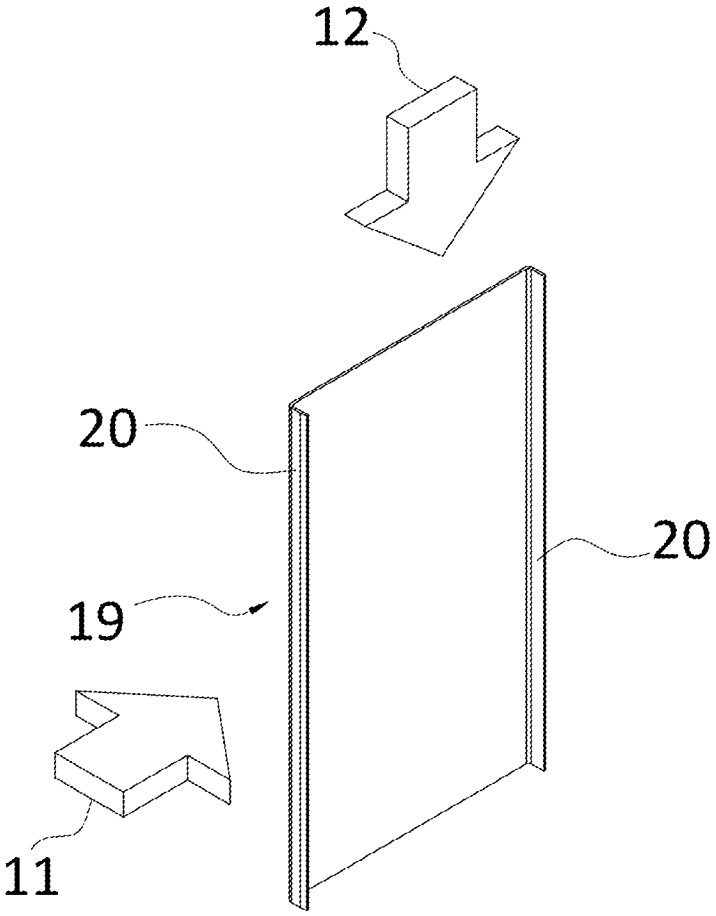
FIG. 7 is an isometric view representing an individual member of the pair of single folded side wall channels of FIG. 6.
Figure 6:
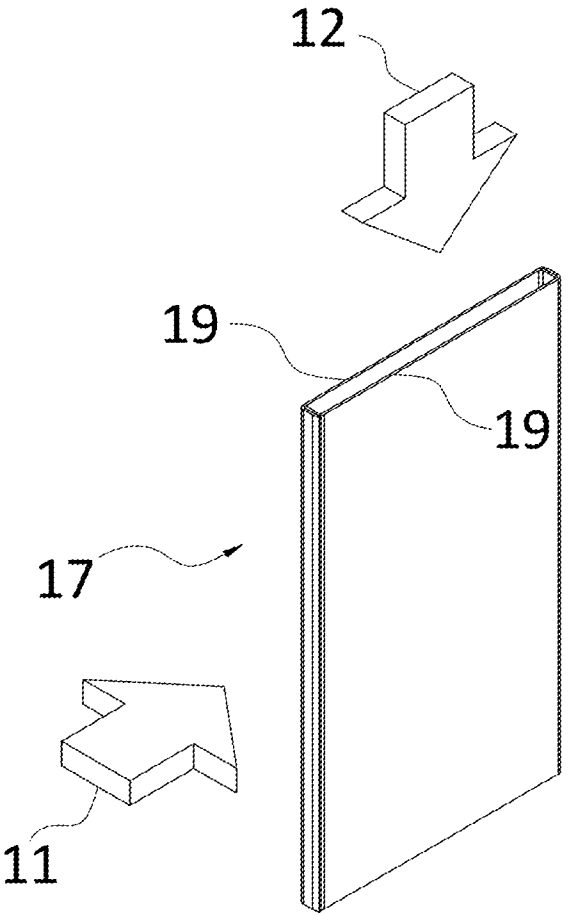
FIG. 6 is an isometric view representing an isolated side wall formed by a pair of single folded side wall channels of the type represented in FIG. 2.

Oppositely disposed sides of each of the first and second fluid passages are fluidically closed with elongated spacer bars 15 and side walls 17, respectively, that are longitudinally aligned with the flow paths of the corresponding fluid passages. Each of the side walls 17 are defined by folded portions 21 of a pair of adjacent channels 19 coupled to define a joint. For example, FIG. 3 represents an enlarged view of an end of one of the side walls 17. As represented, the side walls 17 are formed by bending end portions of adjacent channels 19 approximately ninety degrees to produce folded portions 21 extending perpendicular to unfolded portions of the channels 19 that separate the first and second fluid passages, referred to herein as the body of each channel. The end portions are formed in folding directions perpendicular to both the flow path of the first and second fluid passages, that is, in directions parallel between the side plates 10. The side walls 17 form a barrier substantially perpendicular to the flow path of the first fluid passage (arrow 11) and having a thickness that is at least twice as thick as the body of the channel 19. FIG. 6 represents an isolated view of a pair of adjacent channels 19 coupled to one another to define the side walls 17. FIG. 7 represents an isolated view of an individual member of the pair of channels 19 of FIG. 6 representing folded portions 21 located on opposite edges of the member extending perpendicular to the body of the member.

Figure 5:
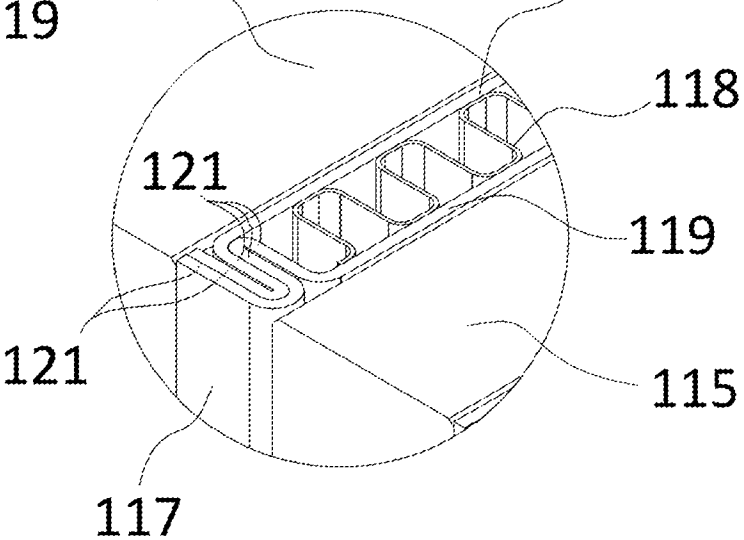
FIG. 5 is an enlarged view of section B of FIG. 4.
Figure 4:
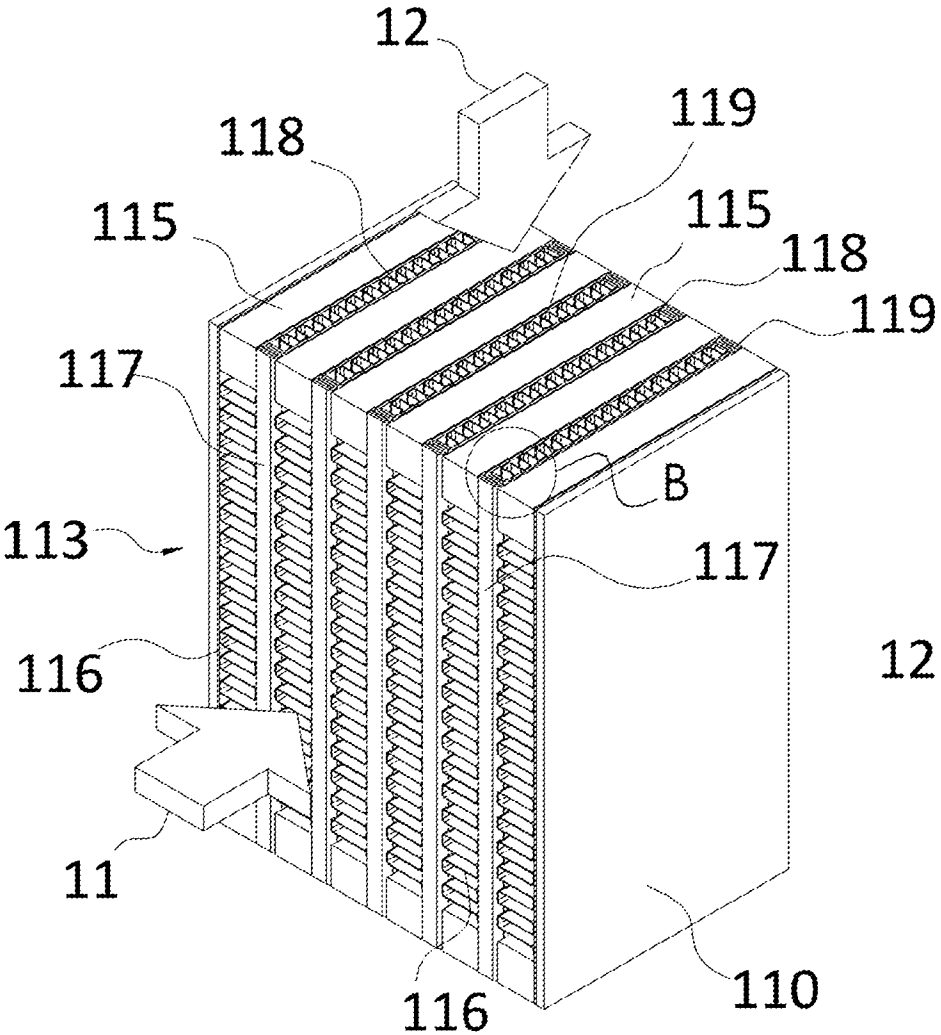
FIG. 4 is an isometric view representing a channel fin heat exchanger core in accordance with a second embodiment of the present invention.

As another example, FIGS. 4 and 5 represent a second embodiment of a channel fin heat exchanger core 113 substantially identical in structure and function to the channel fin heat exchanger core 13 but with a different fold pattern. In these figures, consistent reference numbers are used to identify the same or functionally equivalent elements, but with a numerical prefix (1, 2, or 3, etc.) added to distinguish the particular embodiment from the embodiment of FIG. 1. FIG. 5 represents an isolated view of an end of one of side walls 117. As represented, the side walls 117 include multiple folded portions 121 resulting in a more complex barrier capable of use at increased pressures relative to the side walls 17 of FIGS. 1 through 3.

Figures 8, 9, 10:
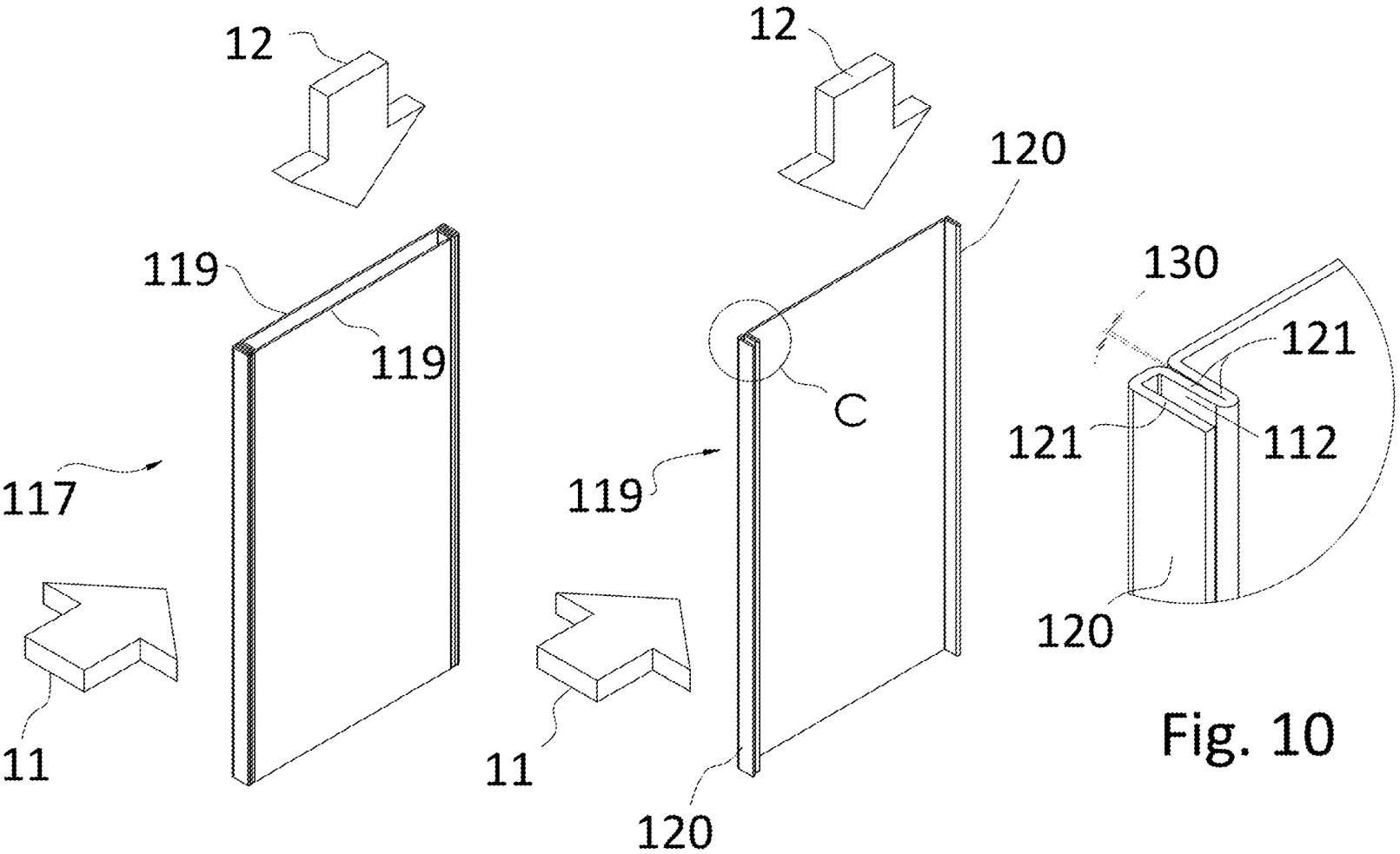
FIG. 8 is an isometric view representing an isolated side wall formed by a pair of multi-folded side wall channels of the type represented in FIG. 4.
FIG. 9 is an isometric view representing one of the multi-folded side wall channels of FIG. 8.
FIG. 10 is an enlarged view representing section C of FIG. 9.
Figure 11A:
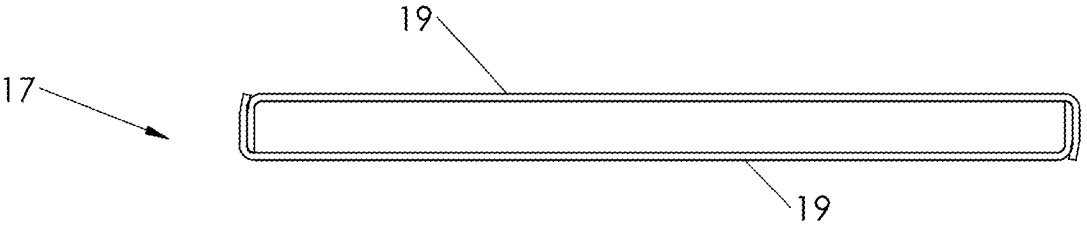
FIGS. 11A-D represent cross-section views of pairs of assembled channels with various fold patterns.
Figure 11B:
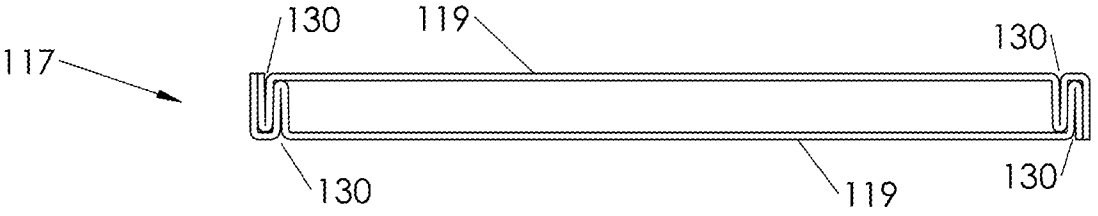
Figure 11C:
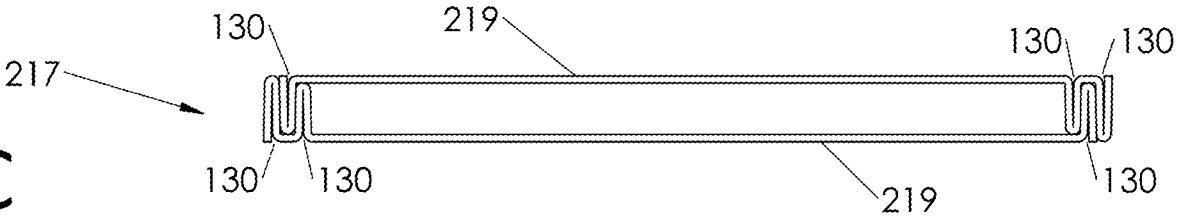
Figure 11D:
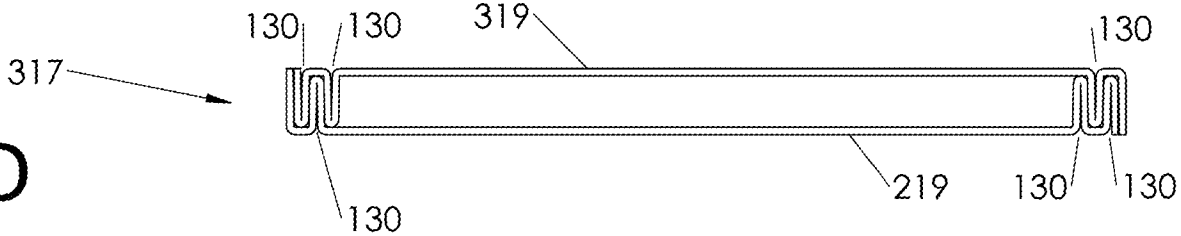

FIG. 8 represents an isolated view of pair of adjacent channels 119 coupled to one another to define side walls 117. FIG. 9 represents an isolated view of an individual member of the pair of channels 119 of FIG. 8. FIG. 10 represents an isolated view of an edge of the channel 119 of FIG. 9. As represented, the channel 119 includes (from interior to exterior) a V-shaped pair of adjacent first and second fold portions, a third fold portion, and a U-shaped recess or spacing 112 defined between the second and third fold portions, wherein the spacing 112 is configured to receive a V-shaped pair of adjacent fourth and fifth fold portions on a corresponding channel 119. For convenience, the folded portions 121 of each edge of a channel 119 are referred to as a partial fold pattern 120, whereas a fold pattern is considered complete when the partial fold patterns 120 of adjacent channels 119 are coupled to form a joint. Once a pair of channels 119 are coupled, the resulting side walls 117 have thicknesses that are at least five times as thick as the bodies of the channels 119.

Figure 12A:
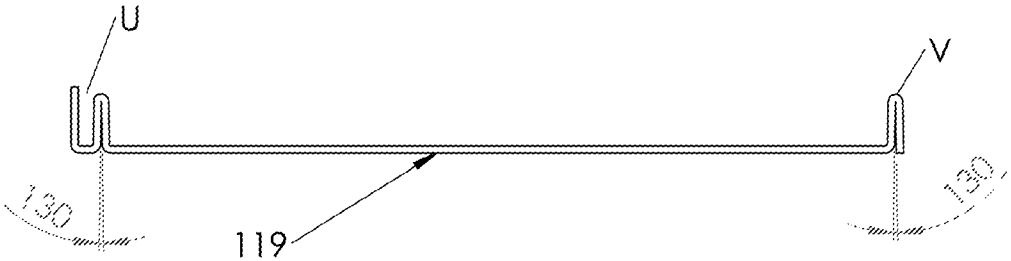
FIGS. 12A-C represent, respectively, isolated cross-section views of the lower channel of the pairs of assembled channels represented in FIGS. 11B-D.
Figure 12B:
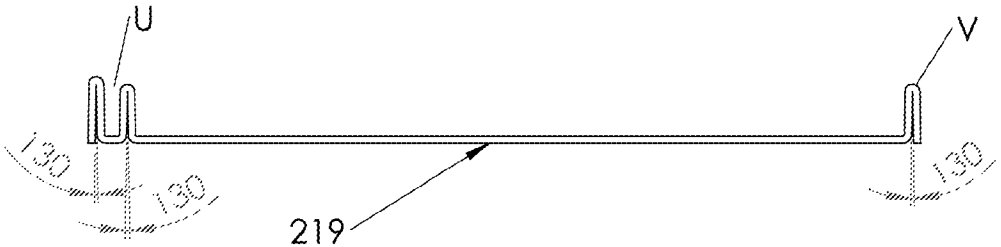
Figure 12C:
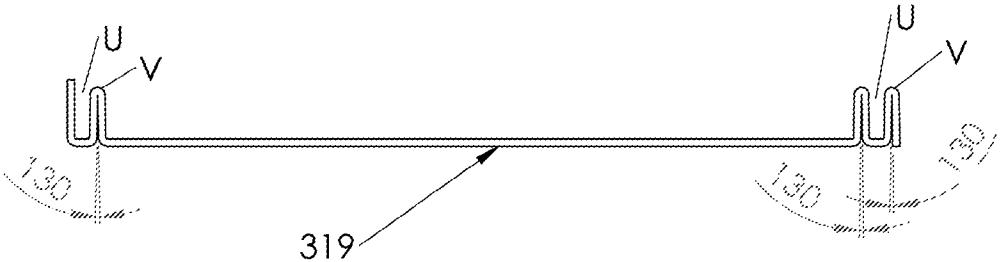

In view of the above, it should be understood that the edges of the individual channels (e.g., 19 and 119) may have one or more folded portions (e.g., 21 and 121) and define one or more spacings 112 and may subsequently be coupled to form overlapping and/or interlocking side walls (e.g., 17 and 117). FIGS. 11A-D represent pairs of assembled channels 19, 119, 219, and 319 with various nonlimiting fold patterns, including adjacent folded portions 121 that form V-shaped pairs and U-shaped spacings 112. FIGS. 12A-C represent, respectively, isolated cross-section views of the lower channel of the pairs of assembled channels represented in FIGS. 11B-D, with V-shaped pairs labeled as "V" and U-shaped spacings 112 labeled as "U". Although various fold patterns are foreseeable and within the scope of the invention, the resulting side walls (e.g., 17 and 117) preferably define barriers that are perpendicular to the flow path of the first fluid passage (arrow 11) and are thicker than the bodies of the channels. It should also be understood that increasing the number of folded portions 121 in the fold patterns generally increases the maximum operating pressure capability of the channel fin heat exchanger and increases the rigidity and durability of the exterior structure thereby improving the heat exchanger's resistance to impact and leaks. In addition, the fins 16 and 18 in channel fin heat exchanger may provide additional internal column strength for higher flow pressure and provide increased internal contact surface area promoting improved heat transfer efficiency.

Although the channels 19 and 119 may be formed by various processes, the overlapping and/or interlocking channel structure described herein provides for the individual members to be formed by an automatic or semiautomatic, continuous process. For example, channels may be formed to include edges with partial fold patterns and a predetermined length from a continuous, elongated, and generally planar sheet or strip of a metal with one or more clad layers of brazing material thereon. The strip may be advanced in its longitudinal direction along a forming path wherein the strip is ultimately formed into multiple individual channels. Within the forming path, the surface of the strip may be flattened using, for example, sets of rolling wheels. Subsequently or simultaneously, one or both edges of the strip may be folded to define the desired partial fold pattern of the channels. Preferably, the edges are formed by a continuous rolling process. The formed portion of the strip may then be cut, for example, with a roller, to yield a channel of a desired length. If each pair of channels includes two identical members arranged to interlock or couple with one another as represented in FIGS. 1 through 11, two of the channels formed from the strip may be subsequently combined during the assembly process.

Using this type of continuous process, the channels 19 may be formed by folding both edges of the strip ninety degrees once, for example, with V-shaped or W-shaped rollers, such that the resulting folded portions 21 are perpendicular to unfolded portions of the strip (e.g., the body of the channel 19). Notably, one of the folded portions 21 should be longer than the other folded portion 21 as represented in FIG. 6. Optionally, a tip of the longer folded portion 21 may be additionally bent inward toward the center of the strip, for example, by an amount equal to or between half the thickness of the strip and the thickness of the strip, as represented in FIGS. 3, 6, and 7.

Channels with edges having multiple folds may be formed using substantially the same method by adding additional folding steps, for example, using a combination of V-shaped, W-shaped, and/or U-shaped rollers aligned parallel to the forming path, to form the desired partial fold patterns. These folds may be formed consecutively or simultaneously. The width of the spacing 112 ("U" in FIGS. 12A-C) should be at least equal to the thickness of the V-shaped pair ("V" in FIGS. 12A-C) of adjacent folded portions 121 formed on the other edge. The outermost fold of the edge comprising the spacing 112 should have a length that is longer than all of the other folded portions 121, including the outermost folded portion 121 of the other edge, by at least equal to the thickness of the strip, as represented in FIG. 5. Regardless of the fold pattern and the number of folded portions 121, the resulting side walls are all preferably perpendicular to the center of the strip.

Due to the construction of the channels 19 and 119, the channel fin heat exchanger cores 13 and 113 may be assembled by essentially stacking the various components. Thus, an automatic heat exchanger core assembly machine can build the channel fin heat exchanger cores 13 and 113 with relatively low labor content and at relatively high building rates. Such processes may be compatible with emerging industry trends such as the concept commonly referred to as Industry 4.0. Automating the assembly process may reduce a significant amount of manual labor, raw material inventory, and production lead time relative to conventional manufacturing processes.

Once assembled, a brazing process may be performed to complete the construction of the channel fin heat exchanger cores 13 and 113. While various brazing processes may be used, it is preferred that a controlled atmosphere brazing (CAB) process is performed. The brazed components, including the channels 19 and 119, may use the brazing material alone, or in combination with a braze supportment such as a braze paste. Preferably, the channels 19 and 119 are formed of a multilayer of a braze clad alloy or of a brazing material having a thickness of greater than 0.3 mm to provide an adequate welding joint with a heavy duty tank (e.g., about 2.5 mm thick).

The edges of the channels 19 and 119 may be precisely deformed during the manufacturing thereof in order to control the degree of angles defined between the resulting folded portions 21 and 121. For example, the angle 130 (FIG. 10, FIGS. 11B-D, and FIGS. 12A-C) between both sides of a V-shaped pair ("V" in FIGS. 12A-C) of folded portions 121 is preferably smaller than 3.6 degrees to compensate for any springback and promote interference fits between adjacent folded portions 121 of corresponding partial fold patterns 120 of the channels 19 and 119, including interference fits between the V-shaped "male" pairs of folded portions 121 and the U-shaped "female" spacings 112, during the assembly process. This interference fit promotes the reliability of the resulting brazed joints between mating parts and reduces the likelihood of leaks within the fluid passages.

Brazing clearance is particularly important in applications in which the brazing material could be significantly reduced in thickness during the brazing process, for example, down to about ninety percent of its original thickness. Preferably, once assembled brazing clearances between folded portions 21 and 121 of the channels 19 and 119 are less than 0.127 mm. Clearances below 0.127 mm allow for the channel fin heat exchanger cores 13 and 113 to be brazed in either less commonly used vertical or more commonly used horizontal CAB furnaces, potentially with a 97% to 100% of first pass yield braze rate, which allows for the product line to be fully automated. It is believed that any V-shaped pairs ("V" in FIGS. 12A-C) of adjacent folded portions 121 must have an angle defined between the folded portions 121 of less than 3.6 degrees to have brazing clearances below 0.127 mm when inserted into the spacing 112 ("U" in FIGS. 12A-C) having an inner radius of about one material thickness (i.e., spacing width of about two material thicknesses).

The folded joint side walls of the channels of the channel fin heat exchangers are believed to provide several advantages over the spacer bars and plates of conventional plate fin heat exchangers. As examples, the structures and methods of manufacturing described herein promote and likely result in a reduced heat exchanger weight, reduced cost of assembly, reduced duration of the brazing process, and reduced costs associated with operation of the heat exchanger relative to comparable plate fin heat exchangers.

As a nonlimiting example, a plate fin heat exchanger core having fifty internal passages of 100 mm deep and 1000 mm long may have approximately 220.4 m of braze joint length. In contrast, a channel fin heat exchanger core having the same dimensions and same passage numbers of would have approximately only 20.4 m of braze joint length. Thus, the channel fin heat exchanger would have 90.7% less braze joint length, which suggests that the channel fin heat exchanger would also have a significantly improved first pass yield of braze rate relative to the plate fin heat exchanger.

Unlike tube-header heat exchangers, the channel fin heat exchangers do not require specialty tools to form customized components while providing durability, construction flexibility, heat transfer efficiency, and structural strength on par or more likely exceeding plate fin heat exchangers.

U.S. Pat. No. 4,681,155 to Kredo appears to disclose a heat exchanger assembled by a manual stacking process. While not intending to promote any particular interpretation, it appears that Kredo's process would result in a heat exchanger core having a low braze first pass yield rate and the potential for substantial leaks. For example, regular 180-degree return bends generally have an inner radius equal to about one material thickness of the material being bent. In such instance, the resulting gap or spacing between folded portions has a dimension of about two material thicknesses. Producing a bend with a smaller inner radius inherently causes material stretching (deformation). In addition, if these a U-shaped bends (having an inner radius of less than one material thickness) are not supported in some manner, the material may subsequently springback to cause to form a V-shaped bend.

During a brazing process, a portion of the bent material (e.g., clad) will flow to form the braze joint leaving the bent material thinner than prior to brazing, generally about a ten percent reduction in thickness. If the brazing clearance between components is too large, gaps may form in the braze joint leading to leaks. It is believed that the clearance between folds needs to be smaller than 0.127 mm in order to provide a solid braze joint free of gaps and leaks.

Kredo discloses pairs of members that are combined by having folded portions on a first member with about one material thickness being inserted into spacings between two folded portions on a second member. Based on this assembly configuration, the inner bending radius between the folded portions on the second member would be expected be between one-half to one material thickness in order to receive the folded portion of the first member. Therefore, once assembled there would be a gap between the folded portions of the first and second members, and/or the folded portions of the second member would be deformed. Regardless, it is believed that this type of configuration would result in a brazing clearance of greater than 0.127 mm between folds. As such, it is expected that Kredo's folding process followed by brazing would likely result in gaps between folds which can leak during use.

In contrast, the channel fin heat exchangers disclosed herein are formed with interference fit between adjacent folds, for example, by inserting a pair of V-shaped adjacent folded portions with a combined width of about two material thicknesses into a spacing having a width of about two material thicknesses. As noted previously, the angle between the pair of V-shaped adjacent folded portions should be less than 3.6 degrees to control the combined width the pair of V-shaped adjacent folded portions and promote an interference fit within the spacing. In this configuration, during the brazing process the melted clad material is drawn between the folded portions due to capillary attraction resulting in a solid braze joint without leaks.

Therefore, while the invention has been described in terms of specific embodiments, it is apparent that other forms could be adopted by one skilled in the art. For example, the physical configuration of the channel fin heat exchanger, the fluid passages, the fold patterns of the channels 19 and 119, and their respective components could differ in appearance and construction from the embodiments described and shown in the figures, and various materials could be used in their fabrication. In addition, the invention encompasses additional embodiments in which one or more features or aspects of a disclosed embodiments may be omitted or one or more features or aspects of different disclosed embodiments may be combined. Accordingly, it should be understood that the invention is not necessarily limited to any embodiment described herein or shown in the figures. It should also be understood that the phraseology and terminology employed above are for the purpose of describing the disclosed embodiments, and do not necessarily serve as limitations to the scope of the invention. Therefore, the scope of the invention is to be limited only by the following claims.

The invention claimed is:

1. A heat exchanger comprising:

a series of alternating first and second fluid passages, the first fluid passages having a first flow direction and the second fluid passages having a second flow direction perpendicular to the first flow direction;

channels each having a longitudinal axis parallel to the second flow direction and being located between and separating the first and second fluid passages, the channels being formed of a multilayer of a braze clad alloy or a multilayer of a brazing material, the channels comprising adjacent pairs of the channels each comprising first and second channels coupled together to form the second fluid passages;

side walls located at and sealing sides of the second fluid passages, the side walls having longitudinal axes parallel to the second flow direction and perpendicular to the first flow direction, the side walls being formed by folded portions of the adjacent pairs of the channels, the folded portions of the adjacent pairs of the channels each having a longitudinal axis parallel to the longitudinal axes of the channels and being coupled together to form a joint, the folded portions of at least a first adjacent pair of the adjacent pairs of the channels comprising:

at least one U-shaped pair of adjacent folded portions formed in the first channel to define a spacing therebetween, the spacing extending along a longitudinal length of the first channel and having a width in a direction transverse to the longitudinal axis of the first channel;

at least a first V-shaped pair of adjacent folded portions formed in the second channel, the first V-shaped pair of adjacent folded portions extending along a longitudinal length of the second channel, having a width in a direction transverse to the longitudinal axis of the second channel, and defining an angle therebetween to define a gap between the first V-shaped pair of adjacent folded portions;

at least a second V-shaped pair of adjacent folded portions formed in the second channel to define a second spacing between the first and second V-shaped pairs of adjacent folded portions in the second channel, the second V-shaped pair of adjacent folded portions having a width in a direction transverse to the longitudinal axis of the second channel and extending along the longitudinal length of the second channel; and at least a third V-shaped pair of adjacent folded portions formed in the first channel;

wherein the first V-shaped pair of adjacent folded portions of the second channel is received within the width of the spacing of the first channel, the first V-shaped pair of adjacent folded portions has an interference fit with the U-shaped pair of adjacent folded portions of the first channel, a brazing clearance is present within the gap between the first V-shaped pair of adjacent folded portions, and a braze material is within the brazing clearance;

wherein the third V-shaped pair of adjacent folded portions of the first channel is received within the second spacing of the second channel and has an interference fit with the second spacing.

2. The heat exchanger of claim 1, wherein the side walls have a thickness in a direction parallel to the first flow direction that is larger than a thickness of portions of the channels between the first and second fluid passages in a direction perpendicular to both the first and second flow directions.

3. The heat exchanger of claim 1, further comprising:

spacer bars located at and sealing sides of the first fluid passages, the spacers bars having longitudinal axes parallel to the first flow direction and perpendicular to the second flow direction;

fins located within the first and second fluid passages; and side panels located at and sealing oppositely disposed ends of the series of alternating first and second fluid passages.

4. The heat exchanger of claim 1, wherein the angle between the V-shaped pair of adjacent folded portions of the second channel is less than 3.6 degrees.

5. The heat exchanger of claim 1, wherein the width of the spacing of the U-shaped pair of adjacent folded portions of the first channel is greater than combined thicknesses of the first V-shaped pair of adjacent folded portions of the second channel.

6. A heat exchanger comprising:

a series of alternating first and second fluid passages, the first fluid passages having a first flow direction and the second fluid passages having a second flow direction perpendicular to the first flow direction;

channels located between and separating the first and second fluid passages, the channels being formed of a multilayer of a braze clad alloy or a multilayer of a brazing material; and side walls located at and sealing sides of the second fluid passages, the side walls having longitudinal axes parallel to the second flow direction and perpendicular to the first flow direction, the side walls being formed by folded portions of adjacent pairs of the channels coupled to form a joint;

wherein a first of the channels includes at least one spacing that is defined between two folded portions and is configured to receive a V-shaped pair of adjacent folded portions of a second of the channels, and the V-shaped pair of adjacent folded portions is configured to be received into the spacing to define a brazing clearance between the V-shaped pair of adjacent folded portions and the two folded portions of less than 0.127 mm.

7. The heat exchanger of claim 1, wherein the first V-shaped pair of adjacent folded portions of the second channel is metallurgically joined to the U-shaped pair of adjacent folded portions of the first channel.

8. A heat exchanger comprising:

a series of alternating first and second fluid passages, the first fluid passages having a first flow direction and the second fluid passages having a second flow direction perpendicular to the first flow direction;

channels located between and separating the first and second fluid passages, the channels being formed of a multilayer of a braze clad alloy or a multilayer of a brazing material; and side walls located at and sealing sides of the second fluid passages, the side walls having longitudinal axes parallel to the second flow direction and perpendicular to the first flow direction, the side walls being formed by folded portions of adjacent pairs of the channels coupled to form a joint;

wherein a first of the channels includes at least one spacing that is defined between two folded portions and is configured to receive a V-shaped pair of adjacent folded portions, and the V-shaped pair of adjacent folded portions is configured to be received into the spacing to define a brazing clearance between the V-shaped pair of adjacent folded portions and the two folded portions of less than 0.127 mm.

* * * * *